United States Patent [19]

Stram

[11] 4,201,342

[45] May 6, 1980

[54] MOBILE REFRACTORY APPARATUS FOR REPAIRING INTERIOR FURNACE WALLS

[75] Inventor: George H. Stram, Manchester, Pa.

[73] Assignee: Weldon Hydraulics, Inc., York, Pa.

[21] Appl. No.: 919,129

[22] Filed: Jun. 26, 1978

[51] Int. Cl.[2] ..... B05B 9/00

[52] U.S. Cl. ..... 239/128; 239/165; 239/186

[58] Field of Search ..... 239/165, 169, 186, 187, 239/128, 132.1, 175; 414/694, 723; 266/281

[56] References Cited

U.S. PATENT DOCUMENTS

| | | | |
|---|---|---|---|
| 3,140,785 | 7/1964 | Pilch | 414/694 |
| 3,351,289 | 11/1967 | Demaison | 239/187 X |
| 3,473,737 | 10/1969 | Bowman | 239/187 |
| 3,917,170 | 11/1975 | Marino | 239/165 X |
| 3,957,203 | 5/1976 | Bullard | 239/165 |
| 4,058,258 | 11/1977 | Rosen | 239/165 |
| 4,064,656 | 12/1977 | Zeidler | 239/165 |
| 4,106,760 | 8/1978 | Kono et al. | 118/306 X |

FOREIGN PATENT DOCUMENTS

| | | | |
|---|---|---|---|
| 45-39321 | 11/1970 | Japan | 266/281 |

*Primary Examiner*—John J. Love
*Attorney, Agent, or Firm*—Frailey & Ratner

[57] ABSTRACT

A self-contained, mobile refractory apparatus for repairing interior refractory walls of high temperature industrial ovens and furnaces by spraying fluent refractory slurry mixes to seal cracked and spalled areas thereof. The apparatus is mounted on a vehicle, and includes a base, a rotatable, articulated support mounted on the base, a pivotal gunning lance support secured to the articulated support, an elongated gunning lance mounted on the gunning lance support with capacity for selected reciprocal axial movement, a slurry pipe mounted rotatably within the lance and a spray nozzle affixed to the slurry pipe for spraying slurry. Reversible hydraulic motors impart selected reciprocal movement to the lance and selected rotary movement to the slurry pipe and its nozzle. The lance is constituted by a pair of elongated, concentric tubes having elongated supporting ribs interposed therebetween, to provide high strength and rigidity with minimum deflection in use. By reason of such construction, the lance is provided with a unique liquid cooling system, protecting the internally mounted slurry pipe from overheating. The apparatus is characterized by infinite maneuverability of its parts, under precise and selected control, to position the slurry spray nozzle at any selected location interiorly of an oven within the physical range of the apparatus. The apparatus permits the complete repair servicing of the interior of a conventional coke oven, even at the innermost locations thereof.

18 Claims, 20 Drawing Figures

H
104
75
28
24
18
48
12
17
4
27
29
33
38
26
46
50
10
53
25
36
37
47
2
16
31
6
42
30
87
81
76
99
97
176
179
177
67
200
65
68
19
20

FIG. 5
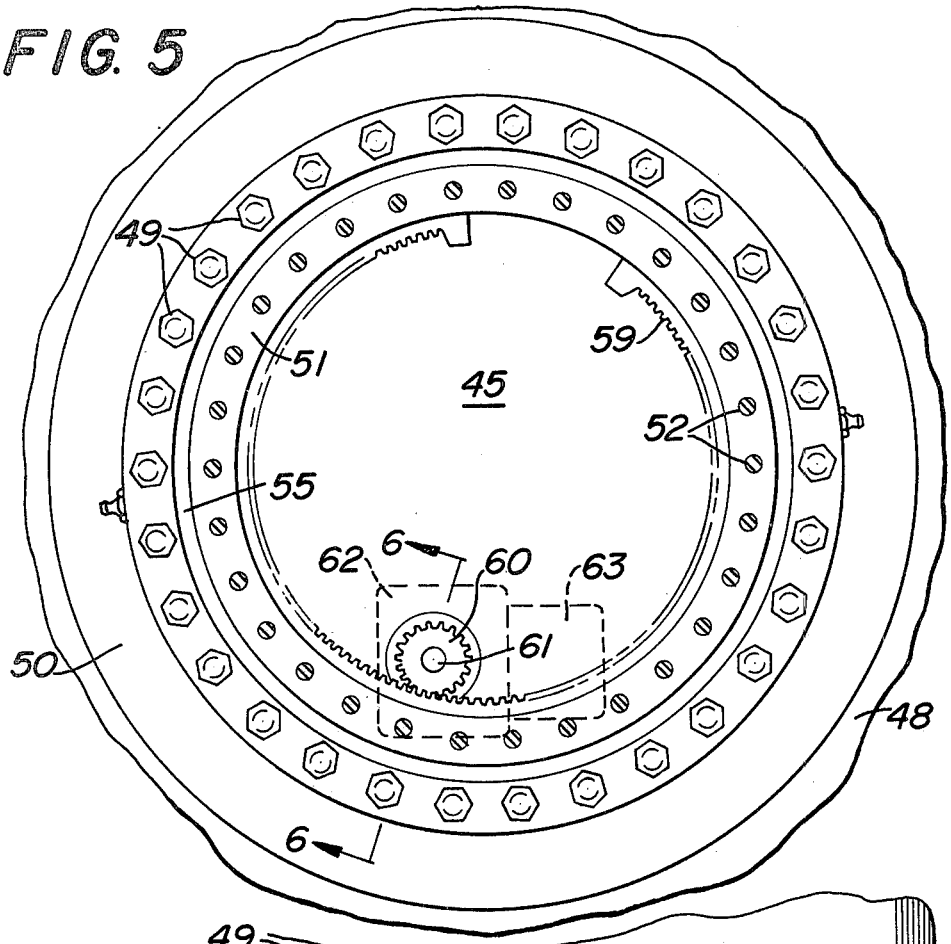
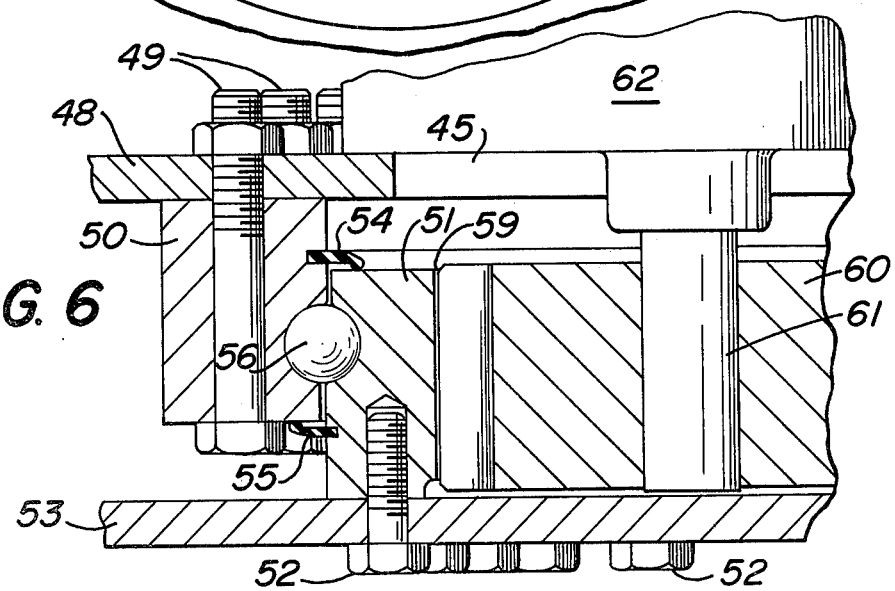
FIG. 6

FIG. 8
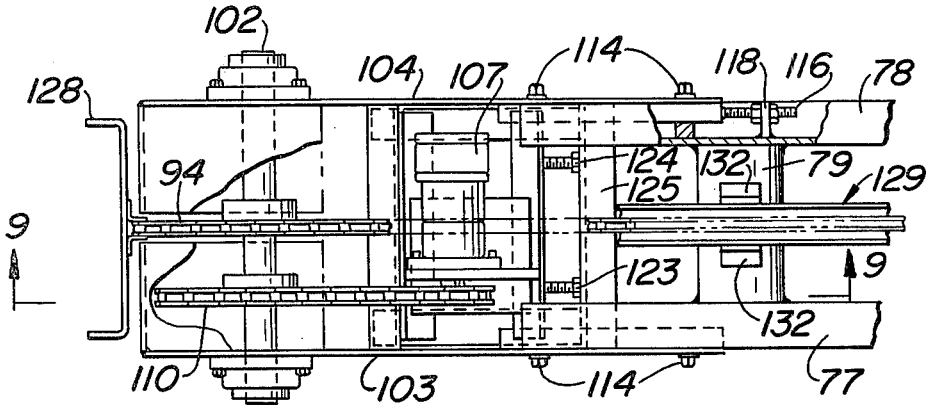
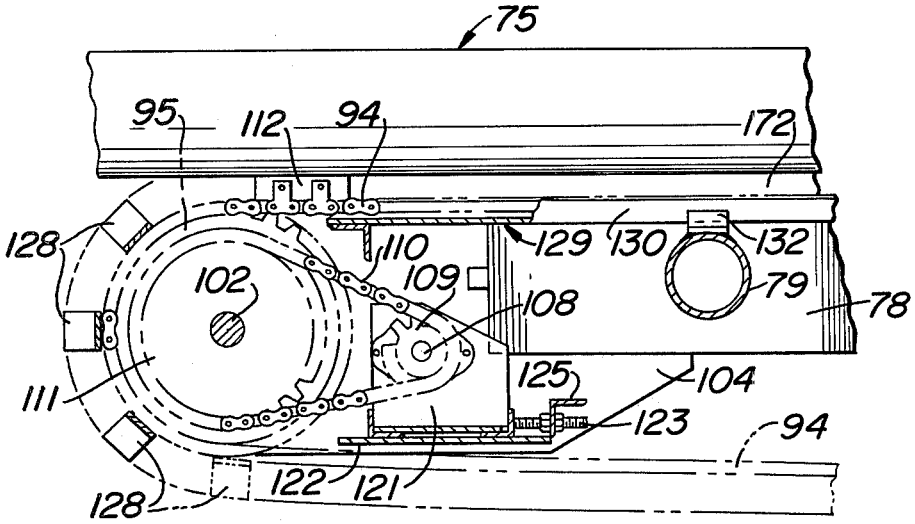
FIG. 9

FIG. 12
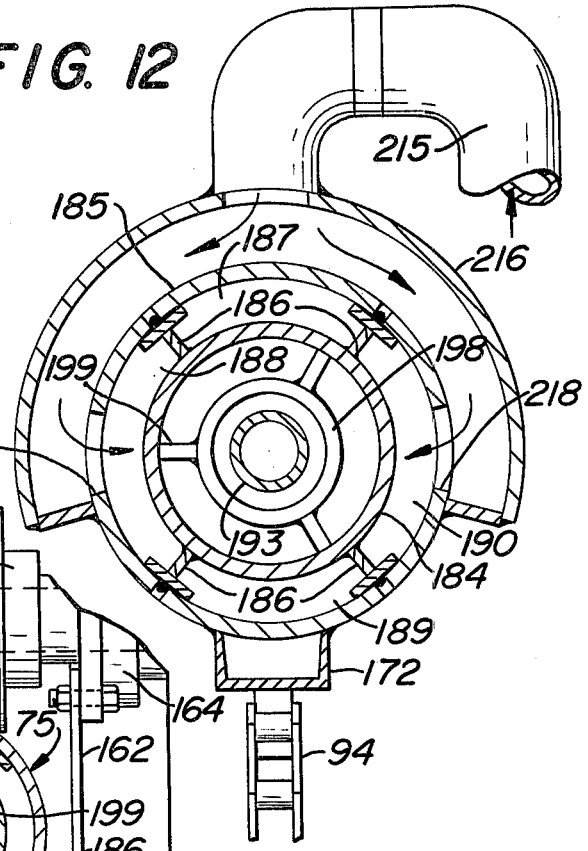
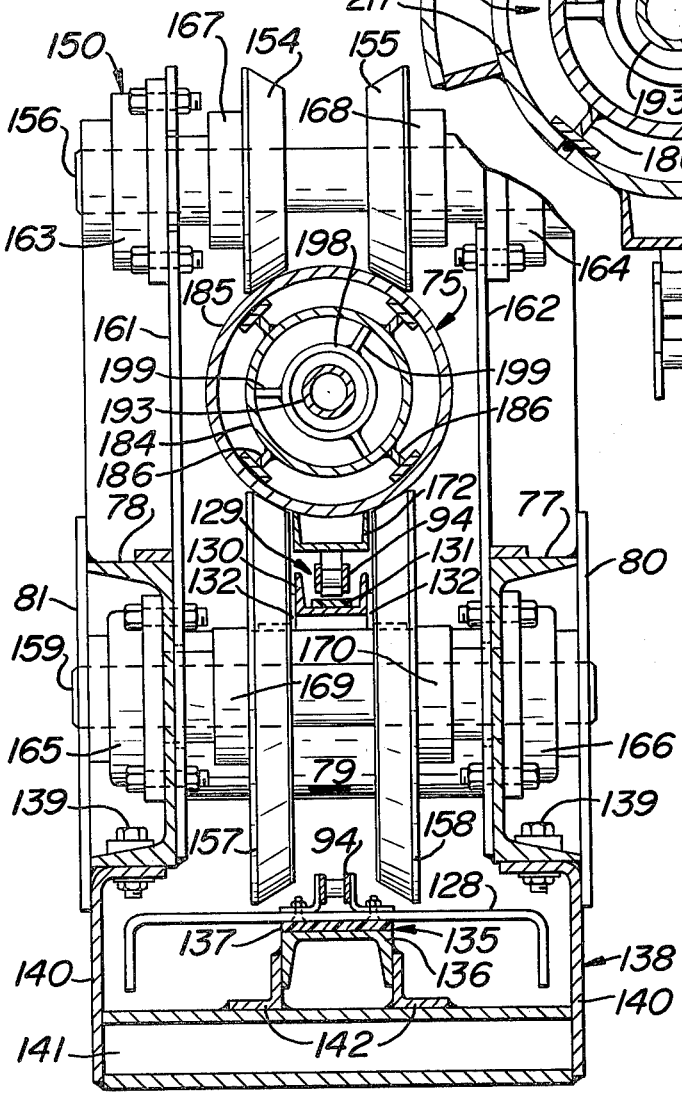
FIG. 13

FIG. 14
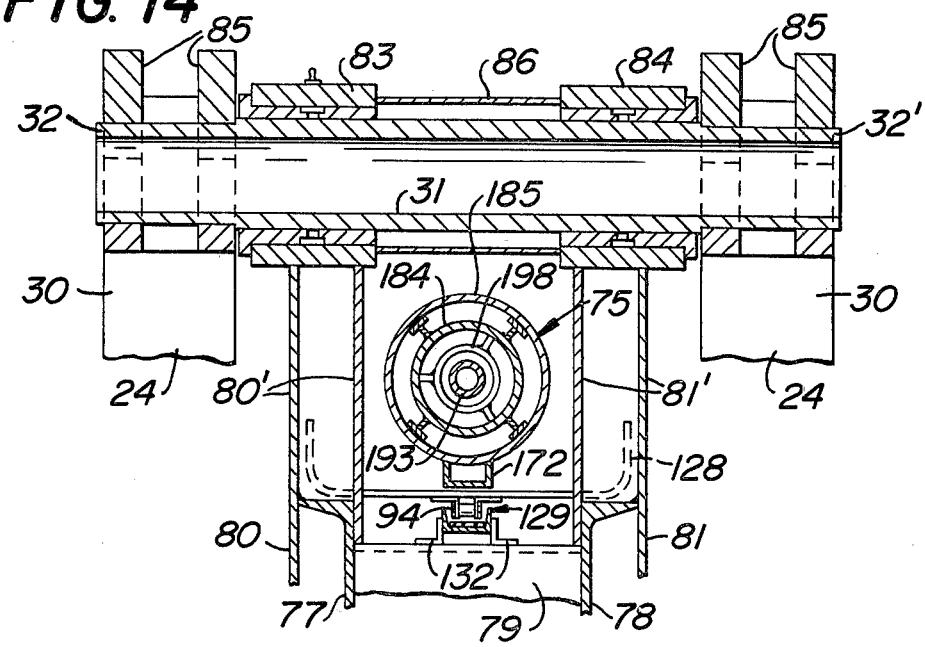
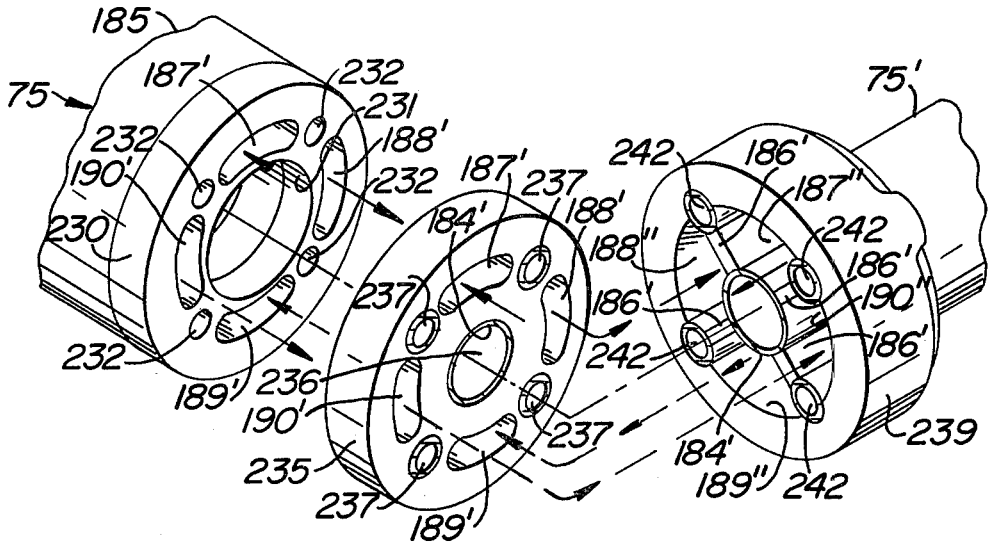
FIG. 15

MOBILE REFRACTORY APPARATUS FOR REPAIRING INTERIOR FURNACE WALLS

BACKGROUND OF THE INVENTION

This invention pertains to mobile refractory apparatus for repairing interior furnace walls. More particularly, the invention concerns refractory gunning apparatus for spraying fluent refractory slurry mixes to patch cracks and spalls in interior refractory walls of high temperature industrial ovens and furnaces to prevent loss of gas and heat therefrom. The invention is particulary useful in repairing the interior refractory walls of coke ovens while the ovens are maintained at their conventional operating temperatures.

The repair of cracked and spalled interior refractory surfaces of industrial ovens and furnaces, while maintaining such devices at their elevated operating temperatures, long has presented unique problems defying solution. Coke ovens, for example, extend up to 40 feet in length, the entire interiors of which are maintained at approximately 2000° F. Because of their size and high temperatures, it is impractical to repair such ovens adequately with manual labor and equipment. Various refractory gunning machines have been designed for repairing interior refractory walls under high temperature conditions, but such machines have achieved only limited degrees of success. Examples of such devices are illustrated by U.S. pat. Nos. 3,473,737, 3,827,633 and 3,957,203. Such known refractory gunning machines lack the broad range of maneuverability to adequately service most coke ovens, and none of them are capable of repairing the innermost areas of such ovens. Such devices, also, when thrust into the high temperature atmospheres of industrial ovens and furnaces have a tendency to overheat and possibly break down because of inadequate cooling systems.

SUMMARY OF THE INVENTION

The primary object of this invention is to provide a new and improved refractory apparatus for repairing interior walls of high temperature industrial ovens and furnaces to prevent the loss of gases and heat therefrom.

A further object of the invention is to provide a self-contained mobile refractory apparatus for repairing the interior walls of coke ovens by spraying fluent refractory mixes to seal cracked and spalled areas thereof at the high temperature conditions under which such ovens are operated.

A further object is to provide such a mobile apparatus with an articulated supporting structure having capacity to be collapsed sufficiently to permit the apparatus to be transported on a vehicle within legal highway limits.

A further object is to provide a mobile refractory gunning apparatus which is self-contained, requiring no external sources of power, water or compressed air.

A further object is to provide a new and improved refractory gunning apparatus having a uniquely maneuverable gunning lance which can be positioned with infinite control at any selected location within a coke oven to patch cracks and spalls in the interior refractory walls thereof.

A further object is to provide a refractory gunning apparatus characterized by a novel, selectively reciprocal gunning lance which supports rotatably a slurry pipe and nozzle with capacity for infinite manipulation of the nozzle relative to the interior refractory walls of a coke oven.

A further object is to provide such an apparatus having a novel, articulated, rotatable support to which the gunning lance is pivotally connected with capacity for selected positionability.

A further object is to provide a new and improved refractory gunning apparatus having a positive drive system for selectively reciprocating a cantilevered gunning lance relative to the interior refractory walls of a coke oven.

A further object is to provide such an apparatus whereof the reciprocal, cantilevered gunning lance has capacity to be advanced into the interior of a coke oven substantially beyond the mid-point thereof.

A further object is to provide such an apparatus having a selectively elevatable articulated support for the gunning lance characterized by precision control for the elevating support to an infinite number of horizontal locations.

A further object is to provide a closed, forced circulation cooling system for such apparatus providing for continuous flow of coolant within the lance to prevent overheating of a slurry pipe mounted rotatably within the lance.

A further object is to provide such an apparatus having a lance characterized by a double wall tubular construction reinforced by interposed continuous ribs to provide high strength and rigidity to the lance, with minimum deflection, even when the lance is located in its most advanced reciprocal position.

A further object is to provide refractory gunning apparatus which may be smoothly and accurately manipulated, with infinite control, to locate a refractory spray nozzle precisely at any selected location within a coke oven within the range of maneuverability of the apparatus.

Other objects and advantages of this invention will become readily apparent from the following description of the preferred embodiment thereof, the same being illustrated in the accompanying drawing.

DESCRIPTION OF THE VIEWS OF THE DRAWING

FIG. 5 is an enlarged, fragmentary view in bottom plan, taken as indicated by the angled arrows 5—5 of FIG. 4, showing the underside of the rotatable carriage on which the gunning lance supporting structure is mounted.

FIG. 6 is an enlarged, fragmentary view in section, taken as indicated by the angled arrows 6—6 of FIG. 5, showing the supporting structure for the rotatable carriage.

FIG. 8 is a fragmentary view in top plan, looking in the direction of the angled arrows 8—8 of FIG. 7A, showing the chain drive end of the gunning lance assembly, with the gunning lance removed.

FIG. 9 is a fragmentary view in section, taken as indicated by the angled arrows 9—9 of FIG. 8.

FIG. 12 is an enlarged transverse view in section of the gunning lance, taken as indicated by the angled arrows 12—12 of FIG. 7A.

FIG. 13 is an enlarged, fragmentary transverse view in section of the gunning lance assembly, taken as indicated by the angled arrows 13—13 of FIG. 7B.

FIG. 14 is a fragmentary transverse view in section, taken as indicated by the angled arrows 14—14 of FIG. 7B, showing the pivotal support for the gunning lance assembly.

FIG. 15 is an exploded view in perspective showing the coupling means for attachment of an extension to the gunning lance.

DETAILED DESCRIPTION OF THE INVENTION

Figure 1:
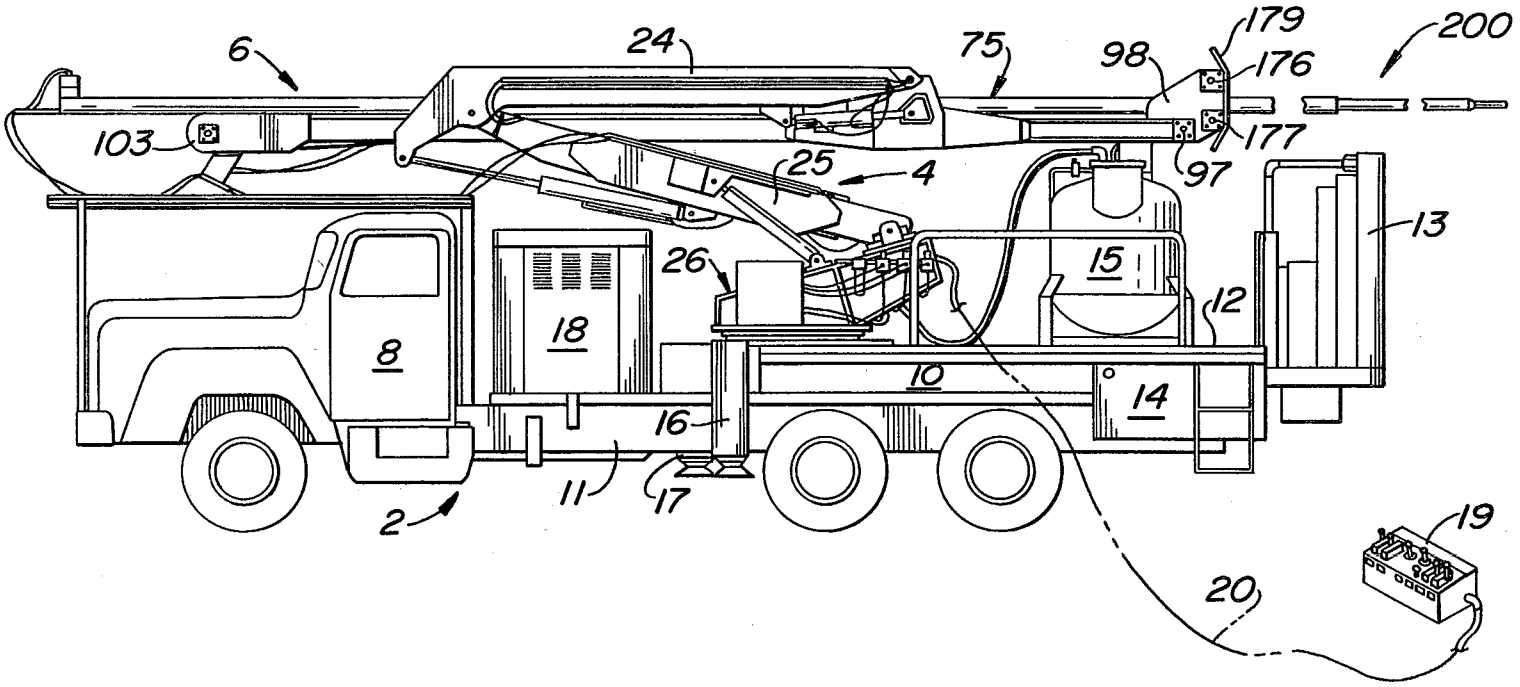
FIG. 1 is a view in side elevation of a preferred mobile refractory apparatus for repairing interior furnace walls embodying this invention.

In FIG. 1 there is illustrated a preferred refractory apparatus of this invention mounted on a self-propelled vehicle 2. The apparatus includes a rotatable, articulated support 4 and a pivotal gunning lance assembly 6.

Mounted on the vehicle 2, for support of the apparatus, is a base 10 comprising a reinforced fabricated steel structure resting directly on the vehicle frame 11. The upper surface of the base 10 comprises a flat heavy rectangular plate 12, which supports the apparatus and various accessories thereto, including a cooling radiator 13 for the lance coolant, a hydraulic fluid reservoir 14, a liquid slurry tank 15 and related valves, controls and piping or conduits of conventional design. The forward end of the base 10 supports two hydraulically actuated retractable outriggers 16, 17, one of which is disposed on each side of the vehicle 2 for stability. Mounted on the frame 11 of the vehicle 2, in the gap between the vehicle cab 8 and the base 10, is an air compressor 18. The apparatus is controlled manually by a portable electric control panel 19 connected to the apparatus by a cable 20. In FIG. 1, the apparatus is shown in its lowermost position, in readiness for transport, with the components of the articulated support 4 fully retracted.

Figure 2:
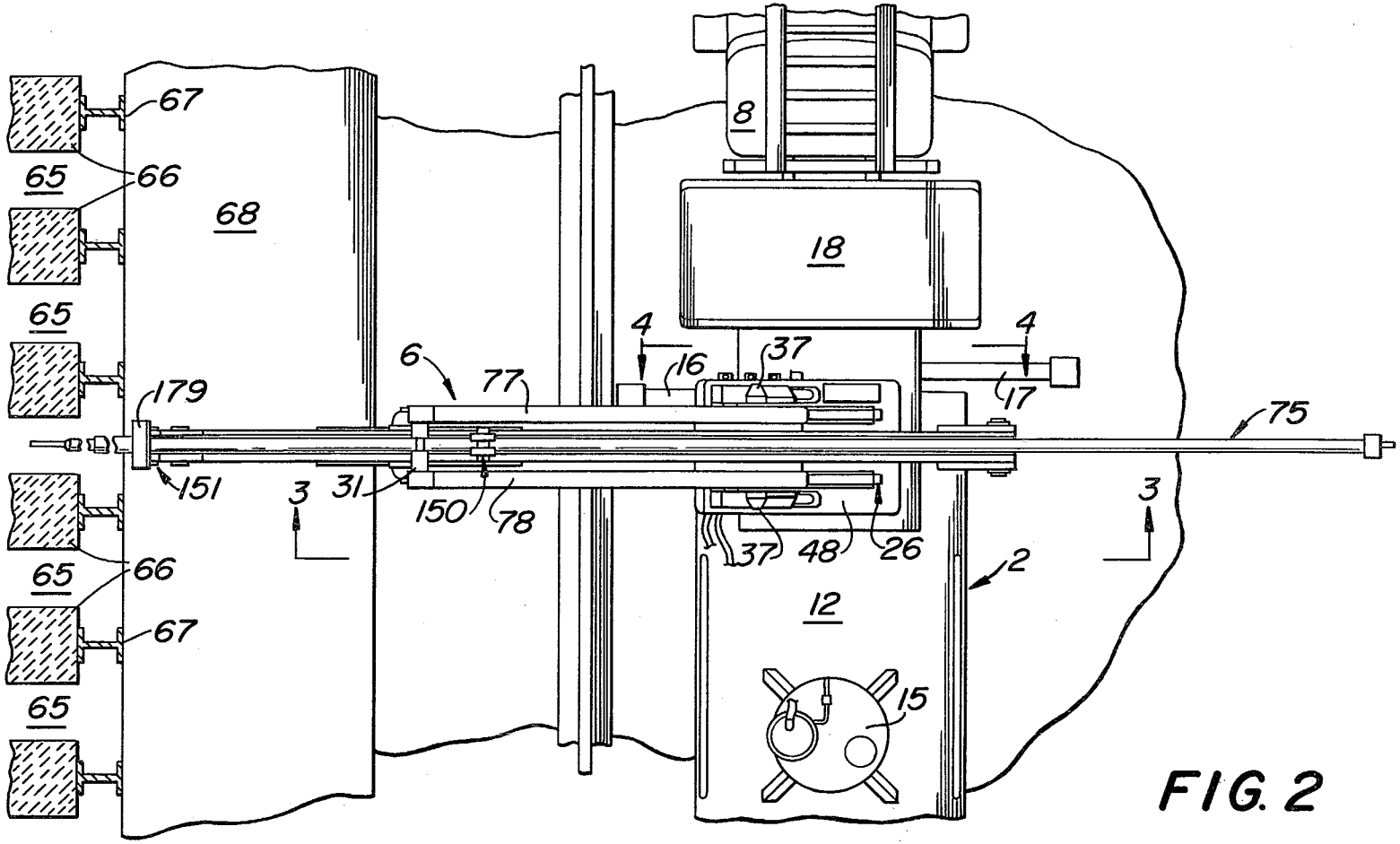
FIG. 2 is a fragmentary view in top plan of the apparatus, disposed in operative position relative to the pusher side of a coke oven, with the supporting structure for the gunning lance disposed transversely of the vehicle.
Figure 3:
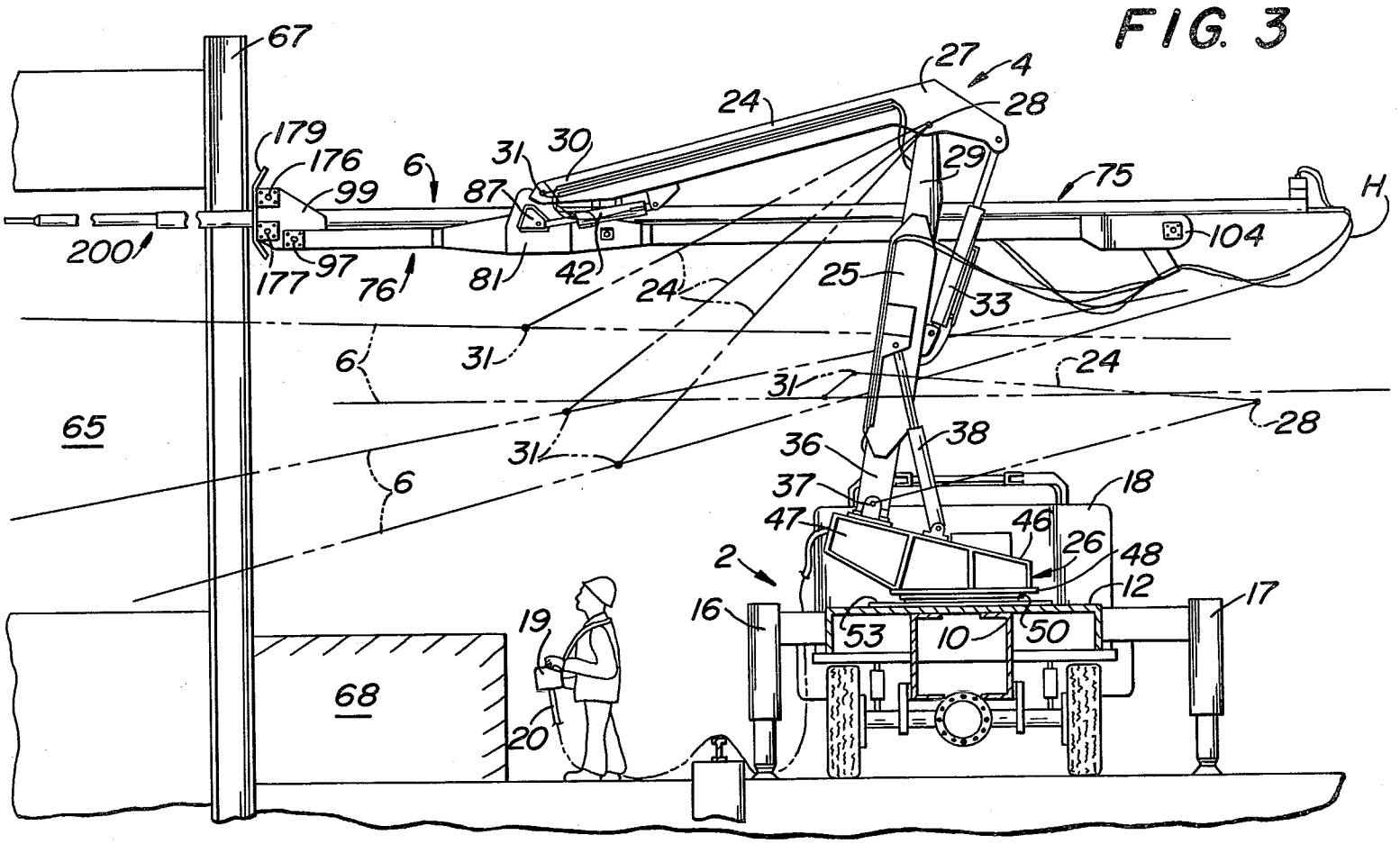
FIG. 3 is a fragmentary view in section, taken as indicated by the angled arrows 3—3 of FIG. 2.

FIGS. 2-6 illustrate in detail the structure and mode of operation of the rotatable, articulated support 4. As best shown in FIG. 3, the support 4 includes an upper member or arm 24, lower member or arm 25 and rotatable carriage 26. The inner end 27 of upper member 24 is connected pivotally, by means of a pair of axially spaced pivots 28, to the upper end 29 of the lower member 25. A pair of selectively controllable hydraulic cylinders 33, 34 (FIGS. 3, 4), mounted pivotally on lower member 25, are utilized to pivot upper member 24 selectively about its pivots 28.

Gunning lance assembly 6 is connected pivotally to the outer end 30 of upper support member 24 by means of a hollow pivot shaft 31. A pair of selectively controllable hydraulic cylinders 42, 43, mounted pivotally on the outer end 30 of the upper member 24, are utilized to pivot the lance assembly 6 selectively about its pivot 31.

The lower end 36 of the lower support member 25 is connected pivotally, by means of a pair of axially spaced pivots 37, to the upper surface of the rotatable carriage 26. A pair of selectively controllable hydraulic cylinders 38, 39, mounted pivotally on the upper surface of the rotatable carriage 26, are utilized to pivot lower member 25 selectively about its pivots 37.

Figure 4:
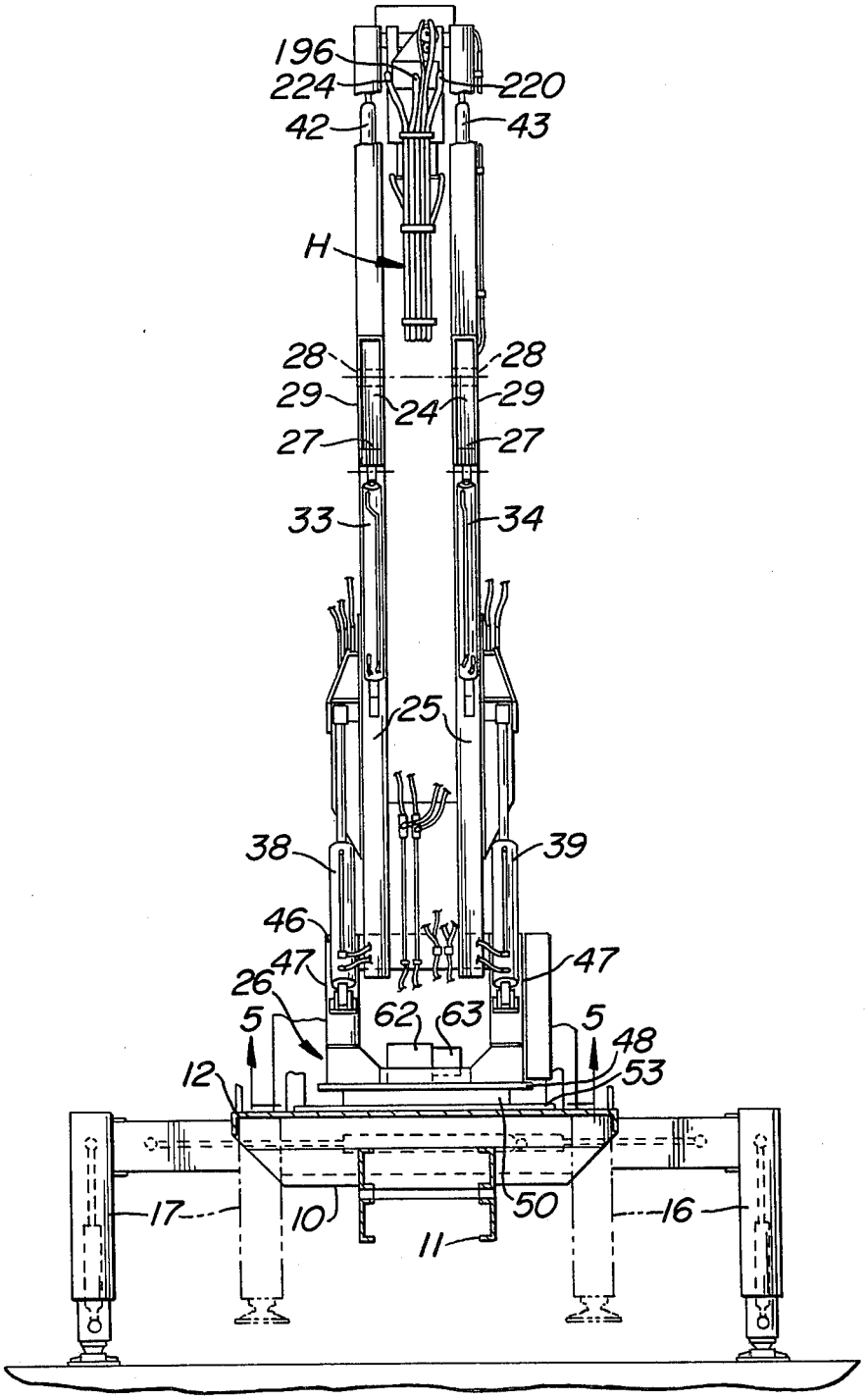
FIG. 4 is an enlarged, fragmentary view in elevation, taken generally as indicated by the angled arrows 4—4 of FIG. 2, but with the supporting structure for the gunning lance disposed longitudinally of the vehicle.

Both the upper member 24 and lower member 25 of the support 4 are of generally bifurcated structure (FIG. 4). Each is constituted by a pair of elongated, parallel, uniformly spaced links or components, the respective proximate ends 27, 29 of which are connected by the spaced pivots 28. The elongated spaces between the parallel links of the articulated support members 24, 25 provide clearance for selective positioning of the lance assembly 6 during use of the apparatus. When the apparatus is in its rest position, as illustrated in FIG. 1, the lance assembly 6 is nestled between the spaced parallel components of the upper member 24, with both lance assembly 6 and member 24 in substantially horizontal disposition. In FIGS. 2 and 3, arm 25 of articulated support 4 is substantially fully elevated, whereas arm 24 has been depressed somewhat, to position the substantially horizontal lance assembly 6 at a location intermediate the upper portions of the spaced parallel components of arm 25. In FIG. 4, the members or arms 24, 25 of support 4 are shown fully extended to their maximum vertical height, with the lance assembly 6 disposed substantially horizontally.

By reason of the bifurcated construction of the upper and lower members 24, 25 of the support 4, and the pivotal connections of those members with each other and with the lance assembly 6 and the carriage 26, the lance assembly is capable of a wide range of parallel and angular motions in any selected vertical plane. Thus, by selective actuation of cylinders 33, 34, 38, 39, 42, 43 under control of panel 19, the lance assembly 6 may be located selectively in a virtual infinite variety of operating positions, within the ranges of movement of the support 4, as exemplified by the phantom lines in FIG. 3.

The rotatable carriage 26 is provided with an upper generally rectangular, open top frame 46 (FIGS. 3, 4), the spaced side portion 47 of which incline upwardly in the direction of the pivots 37. Carriage frame 46 is supported by, and affixed to, a rotatable plate 48 having a large central aperture 45 (FIGS. 5, 6). Affixed to the underside of plate 48, by a plurality of angularly spaced bolts 49 (FIG. 6), is the outer race 50 of a large diameter, annular ball bearing. The inner race 51 of the ball bearing is affixed by a plurality of angularly spaced bolts 52 to a stationary plate 53 which in turn, is affixed, by any suitable means, to the plate 12 of the base 10. Annular seals 54, 55 protect the circle of balls 56, interposed between the inner and outer bearing races 50, 51, from dirt, grime, and other contaminants. Disposed on the inner annular surface of inner race 51 is a ring gear 59, the inwardly extending teeth of which mesh with the teeth of a small pinion 60 (FIG. 5). The pinion 60 is affixed to a vertical rotatable shaft 61 extending downwardly from a conventional gear box 62 through aperture 45, and is driven by a reversible hydraulic motor 63. The motor 63 and gear box 62 are affixed to the rotatable plate 48.

In the arrangement shown, plate 53, inner bearing race 51 and ring gear 59 are stationary. Thus, when motor 63 is activated to drive pinion 60, the carriage ensemble 26, consisting of pinion 60, shaft 61 gear box 62, motor 63, outer bearing race 50, plate 48 and frame 46, is rotatable as a unit about the vertical axis of the ball bearing. The control for the motor 63 preferably limits angular movement of the carriage 26 to an arcuate distance of approximately 200°, extending from one side of the vehicle 2, proximate outrigger 16, rearwardly of the vehicle to the other side thereof, proximate outrigger 17. By means of panel 19, which controls motor 63, the rotatable carriage 26 may be selectively located at any angular position within its arcuate traverse by the controlled rotation of pinion 60 relative to ring gear 59.

By reason of the above-described structure and operation of the rotatable carriage 26, the lance assembly 6 may be positioned selectively in any desired vertical plane within the 200° arcuate range of travel of the carriage. As will be understood, within each selected vertical plane, the pivotal lance assembly 6 may be raised or lowered selectively to any one of an infinite variety of locations, within the upper and lower ranges of the support 4. At each such location in each vertical plane, the lance assembly 6 may be pivoted selectively. Hence, in use the lance assembly 6 may be controllably maneuvered into and out of an infinite selection of horizontal, vertical and angular operating positions.

In FIGS. 2 and 3, the carriage 26 has been swiveled to position the lance assembly 6 transversely of the vehicle 2. In those Figures, the apparatus is shown as being disposed adjacent the pusher side of a battery of coke ovens 65, each separated from the other by means of elongated refractory walls 66. Disposed outwardly of the ends of the oven walls 66 are the usual buck stays 67 and bench 68.

FIGS. 7–14 illustrate in detail the structure and mode of operation of the pivotal gunning lance assembly 6, consisting of liquid cooled, axially reciprocal gunning lance 75, gunning lance support 76 and accessory parts. The gunning lance support 76 includes a pair of elongated, parallel channel beams 77, 78, each having their flanges disposed outwardly (FIGS. 13, 14). The beams 77, 78 are maintained in rigid, uniformly spaced disposition to each other by means of a plurality of longitudinally spaced transverse struts 79. The struts 79 are tubular, and are welded at their ends to the beams 77, 78.

Figure 7A:
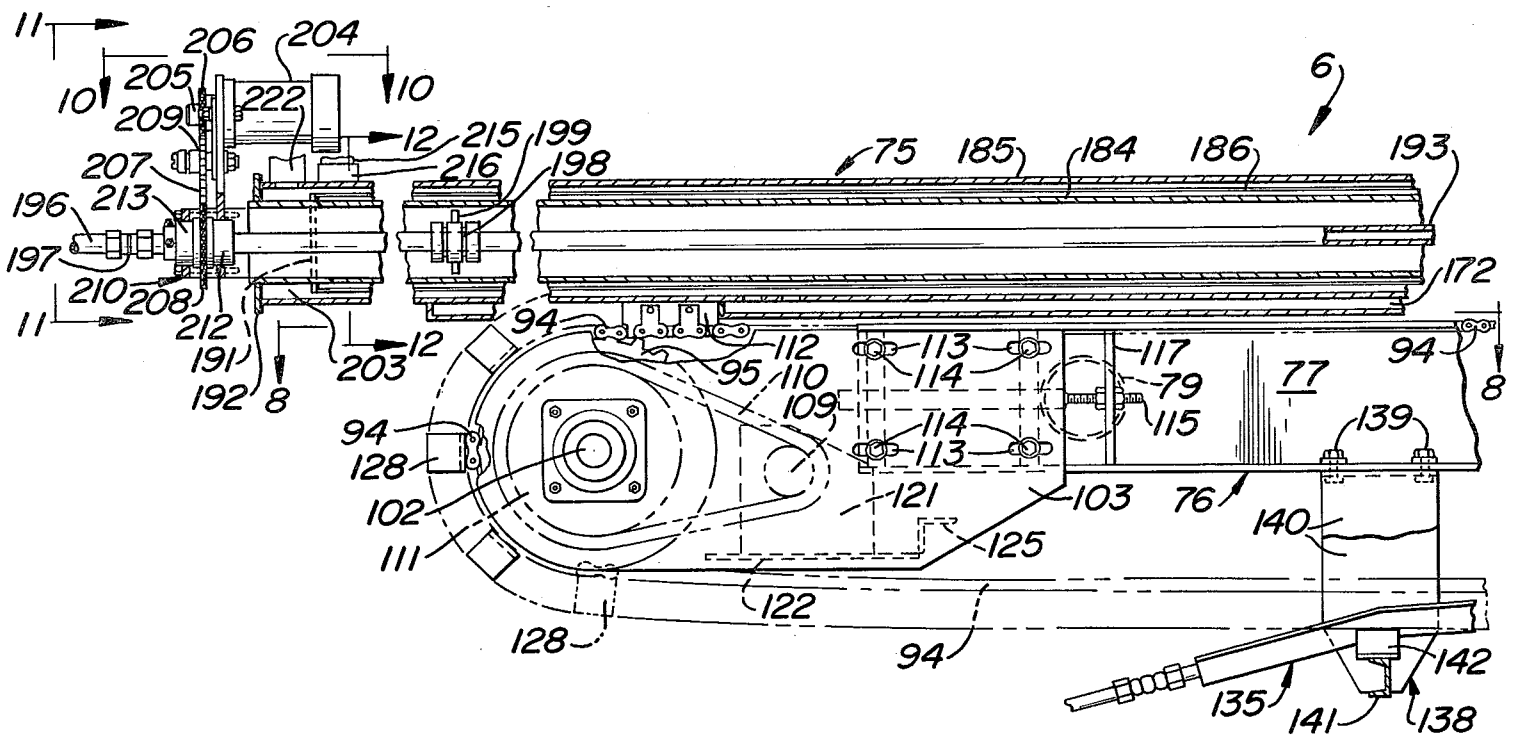
FIGS. 7A, 7B and 7C are enlarged, fragmentary views, partially in section, showing the gunning lance, the lance support and adjacent parts and structures, all of which constitute the gunning lance assembly.
Figure 7B:
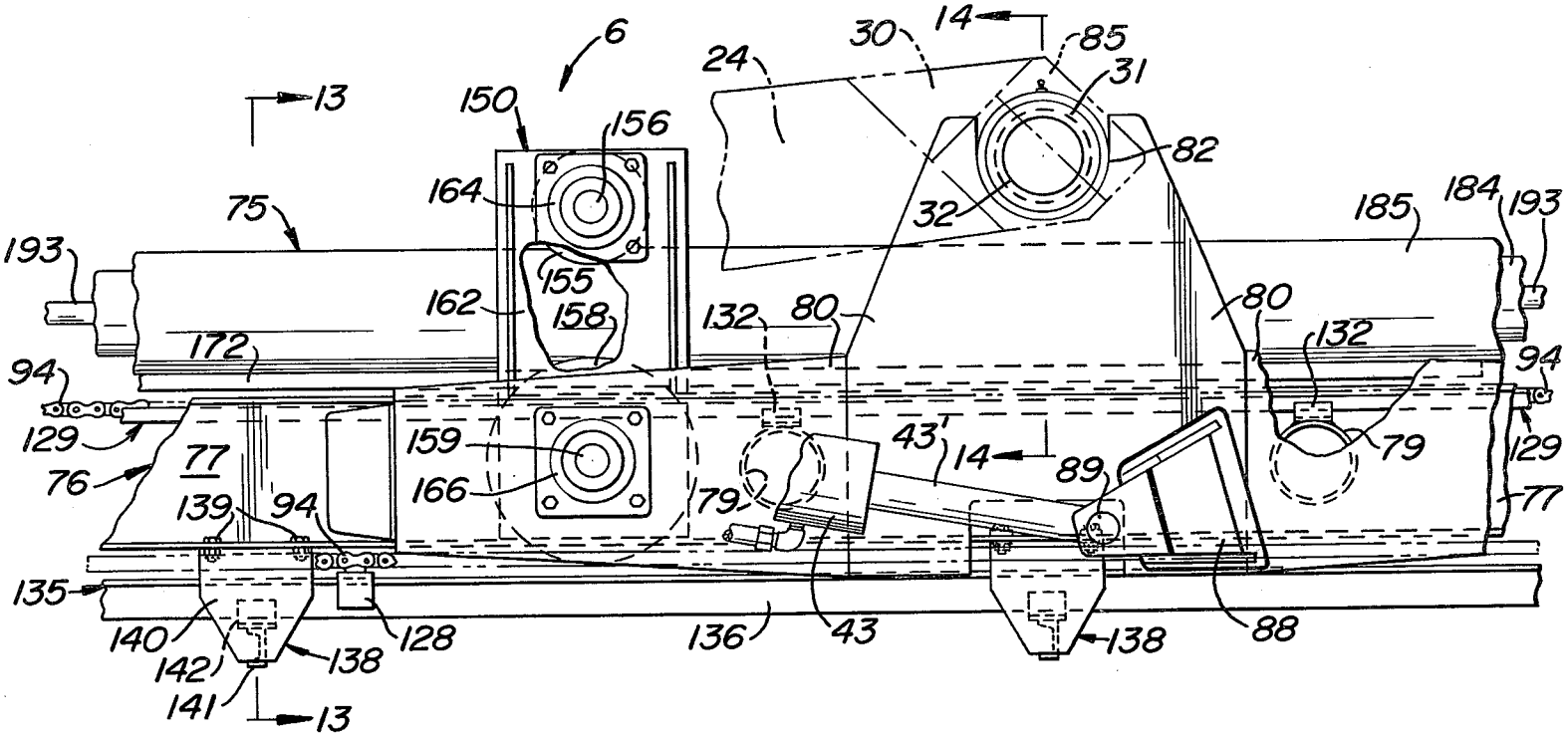

FIGS. 7B, 14 show in detail the pivotal connection between the gunning lance assembly 6 and the outer end 30 of the upper member 24 of the articulated support 4. Affixed to each of the channel beams 77, 78, respectively, preferably by welding thereto, are upstanding, transversely spaced brackets 80, 81. The upper portions of the brackets 80, 81, extending above the beams 77, 78, are constituted, respectively, by parallel, uniformly spaced plates 80', 81' (FIG. 14). Formed in the upper portions of the plates 80', 81' are curved notches of the type illustrated at 82 in FIG. 7B, which retain securely a pair of axially spaced sleeve bearings 83, 84 for rotatable support of hollow pivot shaft 31. Interposed between bearings 83, 84 is a spacer tube 86. The ends 32, 32' of shaft 31 extend outwardly of the bearings 83, 84, and are formed with reduced outside diameters. The outer ends 30 of the two spaced links constituting upper support member 24 are provided with transversely spaced split clamps 85 for engaging and retaining the shaft end portions 32, 32'. Welded to the outside of bracket 80 (FIG. 7B) is a small bracket 88 supporting a pivot 89. The outer end of piston rod 43' of cylinder 43 is connected pivotally to pivot 89. A similar arrangement, including bracket 87 (FIG. 3), is provided on the opposite side of the lance assembly 6 in conjunction with cylinder 42.

Figures 7C, 16, 17, 18:
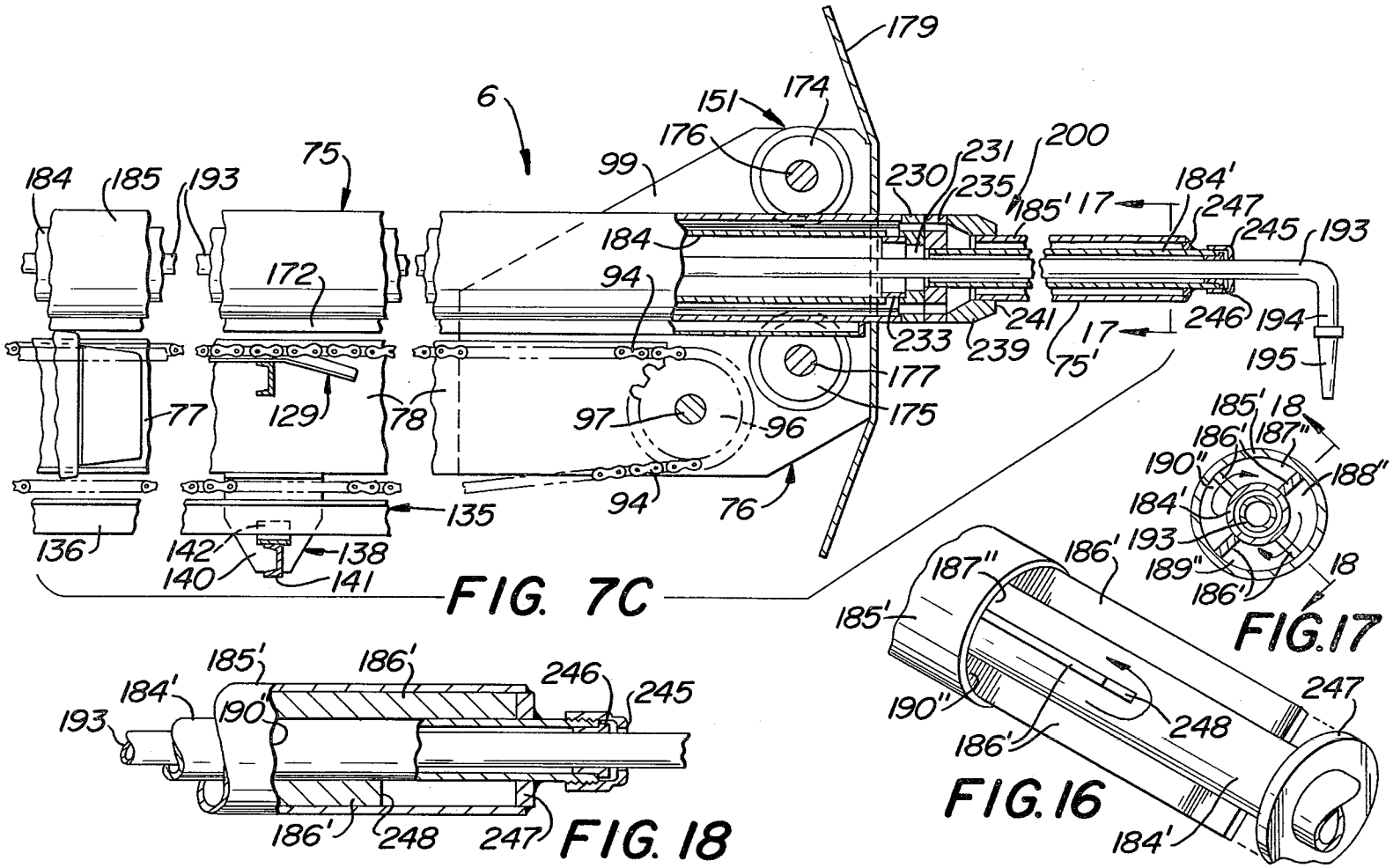
FIG. 16 is an enlarged view in perspective, partially exploded, showing the cooling fluid return structure at the forward end of the gunning lance.
FIG. 17 is an enlarged transverse view in section, taken as indicated by the angled arrows 17—17 of FIG. 7C, also showing the cooling fluid return structure of the gunning lance.
FIG. 18 is an enlarged fragmentary view in section, taken as indicated by the angled arrows 18—18 of FIG. 17.

The lance support 76 includes an elongated, endless sprocket chain 94 entrained about longitudinally spaced sprocket wheels 95, 96. The forward sprocket wheel 96 is affixed to a shaft 97 supported rotatably by axially spaced bearings sustained by a pair of transversely spaced front end plates 98, 99 affixed, respectively, to the forward portions of the channel beams 77, 78 (FIGS. 1, 3, 7C). The rear sprocket wheel 95 is affixed to a shaft 102 supported rotatably by axially spaced bearings disposed in a pair of transversely spaced rear end plates 103, 104 mounted, respectively, on the rear portions of the beams 77, 78 (FIGS. 7A, 8, 9).

Forward and rearward motion is imparted selectively to chain 94 by means of a reversible hydraulic motor 107 (FIG. 8) mounted on lance support 76 and controlled by control panel 19. Motor 107 is provided with an output drive shaft 108 (FIG. 9), to which is affixed a small sprocket wheel 109. A sprocket chain 110 connects sprocket wheel 109 drivingly to a second sprocket wheel 111 affixed to shaft 102. The entrainment of chain 110 about wheels 109, 111 permits motor 107 to drive shaft 102, to impart selected reciprocal movement to elongated chain 94. Chain 94 is affixed, by means of a block connection 112, to the underside of the cylindrical gunning lance 75 (FIG. 7A), to longitudinally advance or retract the lance selectively relative to the lance support 76.

The rear end plates 103, 104, which support rotatably sprocket wheel shaft 102, are selectively adjustable longitudinally of the lance support 76, to maintain the chain 94 slackfree, to the extend desired or necessary. To accomplish this, plates 103, 104 are provided with elongated slots, exemplified by slots 113 in FIG. 7A, through which pass threaded bolts 114 for engagement with correspondingly threaded apertures (not shown) supported by the channel beams 77, 78. Threaded adjustment means 115, 116, supported by vertical brackets 117, 118, respectively, permit selected fore and aft adjustment of the plates 103, 104.

Motor 107 and its shaft 108 and sprocketwheel 109 are affixed to a longitudinally adjustable plate 121 (FIG. 9) which, in turn, is supported slidably by a fixed plate 122 comprising part of the gunning lance support 76. Threaded adjustment means 123, 124, supported by a fixed transverse bracket 125, provide selected adjustment of slidable plate 121, and of motor shaft 108 which it supports, toward or away from sprocket wheel shaft 102, in order to maintain a necessary or desired tension on chain 110.

Fixed at spaced intervals, about 12" apart, on a portion of chain 94 are a plurality of U-shaped support elements 128. Elements 128 provide support for the five hoses H (FIGS. 3, 4) connected to lance 75, and which feed slurry to the lance and convey coolant and hydraulic fluid to and from the lance. Regardless of the axial distance through which lance 75 is advanced longitudinally by reciprocal chain 94, the several hoses H will be adquately supported by the U-shaped elements 128, whereby the hoses may readily advance and retract with the chain powered lance.

Elongated chain 94 is supported in its reciprocal travel by vertically spaced, co-planar upper chain track 129 and lower chain track 135 (FIGS. 13, 14). Upper track 129 comprises an elongated channel 130, the flanges of which extend vertically upward. Disposed along the bottom of channel 130, against which the upper reach of chain 94 travels, is a conventional bearing composition 131, such as teflon or nylon. The channel 130 of upper track 129 is fixed to, and supported by, the several transverse struts 79 by means of pairs of spaced cleats 132.

Lower track 135 includes an inverted elongated channel 136, th flanges of which extend vertically downward. The lower reach of chain 94, including the U-shaped support elements 128 affixed thereto, glides along lower track 135 on any suitable bearing material 137, such as teflon or nylon. Lower track 135 is supported by longitudinally spaced, depending brackets 138 secured to the lower flange of the channel beams 77, 78 by bolts 139. Each bracket 138 is composed of a pair of transversely spaced depending arms 140 connected by a transverse channel 141, the latter supporting a pair of spaced cleats 142 to which the channel 136 of lower track 135 is welded (FIG. 13).

Gunning lance 75 is supported for its reciprocatory axial movement by longitudinally spaced roller assemblies 150, 151 (FIGS. 2, 7B, 7C, 13). Referring to FIG. 13, it will be observed that the rear roller assembly 150 includes two vertically spaced pairs of support rollers, the pairs being disposed on opposite sides of the gunning lance 75. The upper pair of rollers 154, 155 is affixed to rotatable shaft 156, and the lower pair of rollers 157, 158 is affixed to rotatable shaft 159. The four rollers 154, 155 and 157, 158 are frustumshaped, and are mounted so that their respective large diameter portions are disposed outwardly relative to lance 75. The outwardly tapered peripheries of the rollers provide rotatable bearing surfaces for the cylindrical lance 75. The mating support rollers 154, 155 and 157, 158 of each pair are spaced apart axially, on their respective shafts 156, 159, to ensure that their outwardly tapered peripheral surfaces engage snugly with the periphery of the lance 75. By reason of such arrangement, roller assembly 150 firmly supports lance 75 while providing for its longitudinal movement.

Roller assembly 150 also includes horizontally spaced, vertically extending support brackets 161, 162 disposed on opposite sides of the lance 75. Brackets 161, 162 are welded or otherwise secured, respectively, to the inside surfaces of channel beams 77, 78 and extend upwardly therefrom to a suitable height above lance 75. Transversely spaced bearings 163, 164 and 165, 166 are mounted on the brackets 161, 162 for rotatable support of shafts 156, 159, respectively. Suitable apertures formed in the brackets 161, 162 are provided to permit the shafts 156, 159 to extend through and outwardly of the brackets for support by their respective bearings 163, 164 and 165, 166. Spacers 167, 168 and 169, 170 are disposed between the bearings and the rollers to prevent outward axial displacement of the rollers 154, 155 and 157, 158 relative to their shafts 156, 159, thereby ensuring that the mating support rollers are maintained continuously in contact with gunning lance 75.

In similar fashion, forward roller assembly 151 includes two vertically spaced pairs 174, 175 of outwardly tapered rollers for like support of the lance 75 (FIG. 7C). The upper pair of support rollers 174 is affixed, in axially spaced disposition, to rotatable shaft 176, while the lower pair of support rollers 175 is affixed, in axially spaced disposition, to rotatable shaft 177. The vertically spaced shafts 176, 177 are supported rotatably by suitable bearings mounted in the transversely spaced forward end plates 98, 99 (FIGS. 1, 3).

Affixed to the front end of the transversely spaced end plates 98, 99, in advance of roller assembly 151, is a heat shield 179 for protection of the gunning lance assembly 6 during use in repairing the refractory walls of coke ovens or the like.

A vertically depending, elongated rib 172 of rectangular configuration is affixed to, and extends along the bottom of lance 75. Rib 172 is of a transverse width sufficient to engage fully within the gap between the upper portions of the lower axially spaced tapered support rollers 157, 158 (FIG. 13). By this arrangement, rollers 157, 158 engage elongated rib 172 to restrain lance 75 against angular displacement about its longitudinal axis.

The cylindrical lance 75 includes two concentric, elongated, radially spaced tubes 184, 185. As best shown in FIGS. 12, 13 and 14, inner lance tube 184 is retained in spaced radial relation to outer lance tube 185 by four longitudinally extending, angularly spaced ribs 186, which extend substantially the full length of the lance 75. The ribs 186 are of T-shaped cross section, and are welded to the outer surface of inner lance tube 184 and to the inner surface of outer lance tube 185 (FIG. 12). The four ribs 186 divide the longitudinally extending annular space between tubes 184, 185 into four angularly disposed, elongated, fluid tight conduits 187, 188, 189, 190 for circulation of liquid coolant through the lance 75. Thus, the elongated ribs 186 not only provide structural rigidity for the lance tubes 184, 185, but they also serve as guide channels for the lance cooling fluid. Preferably, the four arcuately spaced ribs 186 are located at 90° intervals about lance 75, whereby the four liquid coolant conduits 187–190 are of substantially equal angular cross-sectional area.

The front ends of concentric tubes 184, 185 and of the four ribs 186 disposed intermediate those tubes terminate adjacent the forward end of lance 75 (FIG. 7C). Lance 75 is extended longitudinally beyond such terminal locations by various lance extending components 200, the structure of which will be described in more detail hereinafter. The rear end of lance 75 is provided with an apertured end plate 192 (FIGS. 7A, 10, 11), which is welded to the rear end of outer lance tube 185 and to the outer cylindrical wall of inner lance tube 184. The latter extends slightly rearward of outer lance tube 185, passing through a centrally disposed aperture formed in the end plate 192. Spaced longitudinally inward a short distance from end plate 192 is a pair of transversely spaced, arcuately shaped plates 191 (FIG. 7A), which serve as end plates for the fluid tight closure of the rear ends of the transversely spaced lance coolant conduits 188, 190. The rear ends of ribs 186 terminate at locations adjacent end plates 191. Interposed between the spaced end plates 191 and 192 is an annular space 203 defined radially by the spacing between the concentric inner and outer lance tubes 184, 185.

Figure 10:
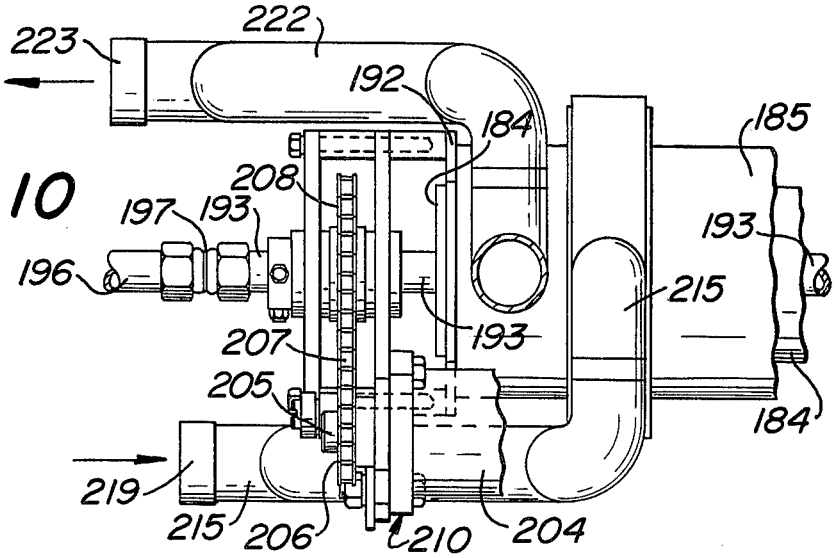
FIG. 10 is an enlarged fragmentary view of the rear end of the gunning lance, looking in the direction of the angled arrows 10—10 of FIG. 7A.
Figure 11:
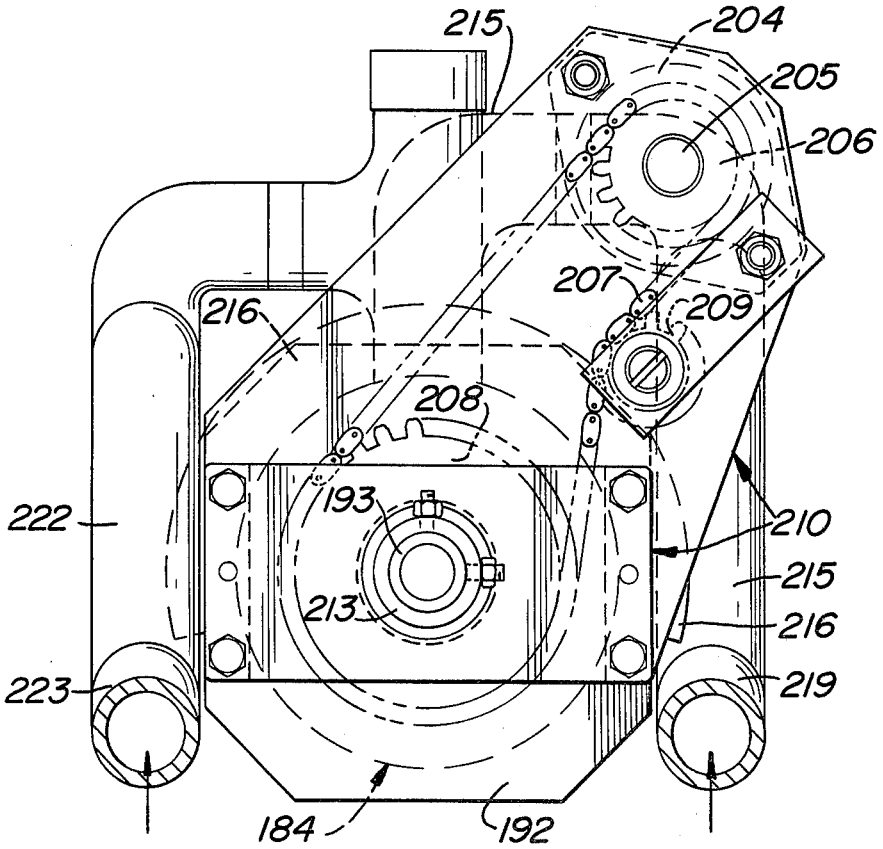
FIG. 11 is an enlarged view of the rear end of the gunning lance, looking in the direction of the angled arrows 11—11 of FIG. 7A.

Concentrically disposed internally of inner lance tube 184 is a rotatable slurry pipe 193 which extends the full length of the lance 75. The front portion of slurry pipe 193 protrudes outwardly beyond the lance extension components 200 at the forward end of the lance 75 (FIG. 7C), and terminates in a right angled segment or portion 194, to the distal end of which is affixed a replaceable nozzle 195. The rear end of slurry pipe 193 extends through and outwardly beyond the end of inner lance tube 184, to connect to a stationary slurry feed hose 196 (FIG. 7A, 10). Hose 196 comprises one of the group of five hoses previously referred to collectively by reference letter H (FIGS. 3, 4). A rotatable coupling 197 connects slurry pipe 193 to hose 196, to permit the slurry pipe to rotate relative to the stationary hose. During use of the apparatus, liquid slurry is fed under high pressure from slurry tank 15 via slurry feed hose 196, coupling 197 and slurry pipe 193 to slurry nozzle 195. Air compressor 18 provides the necessary pressure for this purpose.

Slurry pipe 193 is supported rotatably internally of inner lance tube 184 by a plurality of longitudinally spaced annular bearings 198 (FIGS. 7A, 13). As best shown in FIG. 13, each bearing 198 is supported by three angularly spaced spider legs 199 rigidly affixed to the inside surface of inner lance tube 184.

Selected clockwise and counter-clockwise rotation is imparted to the elongated slurry pipe 193, about its longitudinal axis, by a reversible hydraulic motor 204 (FIGS. 7A, 10, 11) under the control of panel 19. Motor 204 is provided with an output shaft 205 to which is affixed sprocket wheel 206. Affixed to the rear externally extending portion of slurry pipe 193, intermediate tube 184 and coupling 197, is a sprocket wheel 208. An endless sprocket chain 207, entrained about sprocket wheels 206, 208, connects the slurry pipe 193 drivingly to motor shaft 205. To control the tension on sprocket chain 207, an adjustable idler sprocket wheel 209 (FIG. 11) is interposed between sprocket wheels 206, 208. Stationary bearings 212, 213, disposed on opposite sides of sprocket wheel 208, rotatably support the rear end of slurry pipe 193. Motor 204 and its sprocket chain drive to slurry pipe sprocket wheel 208, together with bearings 212, 213, are supported by a suitable supporting structure designated generally by the reference numeral 210, affixed to lance end plate 192. By selectively controlling the hydraulic motor 204, slurry pipe 193 may be rotated about its longitudinal axis to position slurry pipe nozzle 195 at any angular location desired in the use of the apparatus.

Referring to FIGS. 7A, 10, 11 and 12, the connections of the liquid coolant flow system to the gunning lance 75 now will be explained. A coolant inlet pipe or conduit 215 is connected to an arcuately shaped manifold 216 (FIG. 12) mounted externally on outer lance tube 185 proximate the rear end thereof (FIG. 7A). Manifold 216 communicates with the transversely spaced lance conduits 188, 190 via ports 217, 218, respectively. Inlet pipe 215 is provided with a coupling 219 (FIGS. 10, 11) for connection to coolant delivery hose 220 (FIG. 4). The liquid coolant is discharged from the lance 75 via coolant discharge pipe or conduit 222 (FIGS. 10, 11) connected by coupling 223 to coolant discharge hose 224 (FIG. 4). Coolant discharge pipe 222 communicates with the vertically spaced coolant return conduits 187, 189 in lance 75 via annular space 203 disposed at the rear end of lance 75, which serves as a coolant discharge manifold.

The coolant delivery and return hoses 220, 225 are suitably connected (not shown) to the cooling radiator 13 which cools the returned coolant for reuse. Thus, a closed, self-contained liquid cooling system for the gunning lance 75 is provided, comprising radiator 13, delivery hose 220, inlet pipe 215, manifold 216, ports 217, 218, lance inlet conduits 188, 190, lance return conduits 187, 189, manifold 203, discharge pipe 222 and return hose 224. The unique liquid cooling system of this invention protects the slurry pipe 193 in the use of the apparatus, by effectively shielding the slurry pipe from the approximate 2000° F. temperatures encountered internally of ovens, such as coke ovens, undergoing repair by the apparatus. Since the sides of the slurry pipe 193 are exposed to the highest temperatures internally of the ovens, it is preferable that the transversely spaced side conduits 188, 190 of the lance 75 be utilized as the coolant inlet conduits for the flow of coolant through the lance.

Referring next to FIGS. 7C, 15, 16, 17 and 18, the structure of the gunning lance extension components 200 now will be described. Disposed co-axially at the forward end of gunning lance 75 is a disc 230. The disc is secured in fluid tight relation to the end of outer lance tube 185, preferably by a force fit. As best shown in FIG. 15, disc 230 is provided with a centrally located aperture 231 to provide clearance for the passage of slurry pipe 193. Disc 230 is further provided with four angularly spaced, arcuately shaped conduits 187', 188', 189', 190', which comprise continuations of the lance coolant conduits 187, 188, 189, 190, respectively. Disc 230 is provided with four angularly spaced, internally threaded holes 232. An annular insert 233 (FIG. 7C) is interposed between the end of inner lance tube 184 and disc 230 to provide communication between the hollow interior of tube 184 and disc aperture 231.

Disposed adjacent to disc 230, and aligned axially therewith, is an annular coupling 235 having a centrally located aperture 236 providing clearance for the passage of slurry pipe 193. Coupling 235 also is provided with four angularly spaced, arcuately shaped conduits 187', 188', 189', 190' which, like the corresponding conduits of disc 230, communicate with, and provide extensions of, lance coolant conduits 187, 188, 189, 190, respectively. Also formed in coupling 235 are four angularly spaced tubular bores 237, disposed co-axially with the four threaded holes 232 in disc 230.

Disposed adjacent to coupling 235, and co-axial therewith, is an annular nose piece 239 which rigidly supports reduced lance extension 75'. Nose 239 is provided with a centrally located outer aperture 241 which engages telescopically, and supports in fluid tight relation, the proximal end of reduced lance extension 75'. Nose 239 is provided with four angularly spaced tubular bores 242 (FIG. 15), which are co-axial with bores 237 of coupling 235 and with threaded holes 232 of disc 230. Nose 239, coupling 235 and disc 230 are secured together in fluid tight relation by means of four bolts (not shown) which are inserted into nose bores 242 from the outer end of the nose and extend through the coupling bores 237 to engage threadingly within the threaded holes 232 in disc 230. The disc 230, coupling 235 and the rear portion of nose 239 are of the same outside diameter as outer tube 185 of lance 75.

Reduced lance extension 75' is of a construction similar to lance 75. It is constituted by two concentric, elongated, radially spaced tubes 184', 185'. Inner tube 184' is retained in spaced radial relation to outer tube 185' by four longitudinally extending, angularly spaced ribs 186' (FIGS. 15–18). The ribs 186' are welded to the outer surface of inner tube 184' and to the inner surface of outer tube 185' to provide four angularly disposed, elongated, fluid tight conduits 187", 188", 189", 190", which communicate with, and comprise extensions of, liquid coolant conduits 187, 187', 188, 188', 189, 189', 190, 190', disposed in lance 75, disc 230 and coupling 235, respectively. Like ribs 186 in lance 75, the ribs 186' in reduced lance extension 75' are located at 90° intervals to provide four liquid coolant conduits 187"–190" of substantially equal angular cross-sectional area. Thus, by the arrangement described, liquid coolant passing through lance 75 flows to and from reduced lance extension 75' in the manner indicated by the directional arrows in FIG. 15.

Inner tube 184' of extension 75' extends rearwardly beyond outer tube 185', and engages in fluid tight relation within aperture 236 of coupling 235. The forward end of inner tube 184' extends outwardly of outer tube 185', and is provided at its distal end with externally disposed threads. An internally threaded, apertured cap 245 is secured to the distal end of tube 184' (FIGS. 7C, 18). Cap 245 retains a fluid tight, apertured seal 246 in engagement with the distal end of tube 184'. An annular end plate 247 is welded to the distal end of outer tube 185' and to the cylindrical outside surface of inner tube 184', to provide an outer, fluid tight connection between the two tubes.

As will be observed in FIGS. 7C and 18, rotatable slurry pipe 193 extends through insert 233, aperture 231 of disc 230, aperture 236 of coupling 235, inner tube 184' of extension 75', annular seal 246 and the aperture of cap 245, and is cooled by the liquid coolant circulating through reduced lance extension 75'. Cap seal 246 engages the outer cylindrical surface of slurry pipe 193 in fluid tight relation, to prevent leakage of coolant from the extension 75'.

In order to provide for the return flow of liquid coolant from the reduced lance extension 75', two diagonally spaced ribs 186' are terminated at locations 248 spaced axially from the end plate 247 (FIGS. 16–18), while the other two diametrically spaced ribs 186' extend the full length of extension 75' to end plate 247. This arrangement permits the incoming coolant in conduits 188', 190' to flow into the return conduits 187', 189', as indicated by the curved arrows in FIGS. 16 and 17, for return to the liquid coolant radiator 13. In FIG. 16, for the purpose of illustration, outer tube 185' and outer end plate 247 have been retracted relative to the ribs 186', to illustrate the arrangement for the return flow of the coolant.

The apparatus of this invention is completely self-contained, requiring no external sources of power, water or compressed air. Electricity for operating the various components utilized in the invention is derived from the battery of the vehicle 2. The battery is connected to the remote control panel 19 by a suitable cable (not shown). Hydraulic power is provided by dual hydraulic pumps (not shown) mounted as a unit on the truck frame 11 and driven from a conventional auxiliary power takeoff shaft extending from the vehicle transmission. The dual hydraulic pumps are connected to the hydraulic fluid reservoir 14. If desired, there may be provided two hydraulic fluid reservoirs, one for each unit of the dual hydraulic pumps. One pump of the dual unit drives the fan of lance coolant radiator 13 and the coolant circulation pump (not shown). The other unit of the dual hydraulic pump provides power for the elevation and rotation of the articulated support 4, the advancement and retraction of gunning lance 75 and the rotation of slurry pipe 193, by actuation of the hydraulic cylinders and motors previously described which move those components. The various hydraulic connecting lines are of conventional design, and hence their illustration in the drawing is not necessary. Air compressor 18 is driven by its own self-contained diesel engine.

In case of a failure of the vehicle engine, which could be disastrous if occurring while the apparatus is in use repairing the interior of an oven, an emergency power source is provided. For this purpose, an auxiliary electric motor and hydraulic pump (not shown), drivingly connected together, are secured to the truck frame 11, with the motor connectable to the vehicle battery. In the event of failure of the vehicle engine, the auxiliary power system, actuated by the battery, is utilized to actuate the hydraulic mechanisms of the apparatus to retract the lance from the oven and return the apparatus to its transport position illustrated in FIG. 1.

By reason of its articulated supporting structure, the apparatus of the invention may be collapsed sufficiently to be transported on vehicle 2 within legal highway limits. In preparing the apparatus for use, for example in repairing interior refractory walls of a high temperature coke oven, the vehicle 2 first is aligned parallel to a battery of coke ovens 65 (FIG. 2) adjacent the coke oven bench 68. The vehicle is disposed so that the center line of the apparatus, when swiveled transversely of the vehicle, is substantially aligned with the center line of the coke oven to be serviced. The apparatus then is activated, and the operator, with the manual control panel 19 strapped to his body, prepares to operate the apparatus (FIG. 3). The apparatus first is maneuvered so that its heat shield 179 is placed in contact with the coke oven buck stays 67, relative to which the cantilevered lance 75 may be advanced into the oven 65 any selected distance up to its full extensible length.

Because of the unique maneuverability of the apparatus, due to the wide range of positionability of lance assembly 6, the reciprocal capacity of lance 75 and the angular movement of slurry pipe 193, the operator is enabled to smoothly and accurately, with infinite control, move and position the nozzle 195 at any selected location within an oven 65 within the range of travel of slurry pipe 193. Within such range, the operator can discharge controllably from nozzle 195 fluent refractory slurry mix for deposit on any cracked or spalled area of an interior refractory wall. The invention permits the spray nozzle 195 to be located selectively deep within a conventional coke oven 40 feet in length, well beyond its mid-point. By locating and operating the apparatus at each end of a coke oven, it is possible to service completely the interior of a conventional coke oven regardless of its height or length. The apparatus is particularly useful in the sealing of elongated horizontal and and vertical cracks formed in interior refractory walls.

By reason of the construction of the elongated lance 75, constituted by the concentric tubes 184, 185 and the supporting ribs 186 interposed therebetween, the cantilevered lance is characterized by high strength and rigidity, with minimum deflection, even when located in its most advanced position. The double wall construction of the lance, and the provision for a freely rotatable slurry pipe internally thereof, permits the use of a positive drive for selectively locating the lance at any desired position relative to the interior of a coke oven 65. The lance cooling system prevents overheating of the slurry pipe regardless of the depth to which it is advanced into the oven. Thus, the apparatus of this invention is uniquely designed for the repair of interior furnace walls with optimum reliability and unlimited capacity for accessability to all interior areas requiring repair.

Although a preferred embodiment of this invention has been shown and described therein for the purpose of illustration, as required by Title 35 U.S.C. 112, it is to be understood that various changes, modifications and alterations may be made thereto without departing from the spirit and utility of the invention, or the scope thereof as set forth in the appended claims.

I claim:

1. A refractory gunning apparatus for repairing the interior refractory walls of elongated high temperature industrial ovens such as a coke oven, said apparatus being capable of repairing the innermost areas of the refractory walls and including a reciprocal gunning lance, a slurry pipe mounted rotatably internally of the lance and having a nozzle disposed externally of the lance, a pivotal support for the lance, drive means for reciprocating the lance longitudinally relative to the lance support to advance the lance into and retract the lance from an oven and control means for positioning the lance and nozzle selectively relative to the interior of the oven, the improvement comprising (a) an elongated gunning lance adapted to be advanced deep into an oven to locate the slurry nozzle substantially beyond the mid-point of the oven, (b) internal support means for the lance to stiffen the lance against deflection when the lance is advanced into the oven, (c) cooling liquid conducting means disposed internally of the lance and extending substantially the full length of the slurry pipe to protect the slurry pipe from the heat of the oven and (d) a rotatable articulated support having an upper end connected pivotally to the lance support and having a lower end connected pivotally to a rotatable carriage, (e) said articulated support comprising an upper member and a lower member, said two members being connected pivotally to each other intermediate the rotatable carriage and the pivotal lance support, (f) said upper support member being bifurcated to provide an elongated open space internally of said member to permit the gunning lance to be positioned selectively intermediate the bifurcated components of said upper member.

2. The apparatus of claim 1, further including actuating means mounted on the upper bifurcated support member and connected to the gunning lance support, said actuating means being operative to pivot the gunning lance support selectively relative to the articulated support.

3. The apparatus of claim 1, wherein (a) the lower support member is bifurcated to provide an elongated open space internally of said lower member and (b) the elongated open spaces formed internally of the upper and lower support members are in communication to provide a continuous open space to permit the gunning lance to be positioned selectively intermediate the bifurcated components of said upper and lower members.

4. The apparatus of claim 1, wherein:

(a) the gunning lance is of tubular construction constituted by a pair of concentric inner and outer lance tubes, (b) a plurality of elongated longitudinal ribs are interposed between the inner and outer lance tubes, to secure the tubes in radially spaced relation relative to each other, said ribs extending continuously substantially the full axial length of the lance, and (c) a restraining means is interposed between the lance and the lance support to secure the tubular lance against angular displacement about its longitudinal axis.

5. The apparatus of claim 4, further including spaced roller assemblies mounted on the lance support for supporting the tubular lance with capacity for reciprocal axial movement.

6. The apparatus of claim 1, wherein a plurality of hoses are connected to the gunning lance for delivery of a fluent refractory slurry to the slurry pipe and for delivery and return of liquid coolant to and from the lance, characterized by a plurality of spaced, reciprocally moveable hose support elements mounted on the gunning lance support and automatically operative to support the plural hoses during reciprocable movement of the slurry lance.

7. The apparatus of claim 1, further including a closed, forced circulation liquid cooling system for the apparatus, said cooling system including:

(a) a cooling radiator, (b) a plurality of angularly spaced liquid coolant conduits extending substantially the full length of the gunning lance, said conduits being spaced radially outward relative to the slurry pipe to provide a protective shield of liquid coolant for the slurry pipe, and (c) conduit means connecting the lance coolant conduits to the radiator.

8. The apparatus of claim 1, wherein the drive means for imparting reciprocal movement to the lance comprises:

(a) an elongated, endless chain disposed on the gunning lance support and connected to the gunning lance, (b) a pair of spaced, rotatable wheels about which the endless chain is entrained, (c) a reversible hydraulic motor having an output shaft connected to one of the wheels and (d) a selectively controllable hydraulic system for the hydraulic motor operative to actuate the motor to impart selected reciprocal movement to the chain and to the gunning lance connected thereto.

9. The apparatus of claim 8, further including:

(a) a plurality of hoses connected to the gunning lance and moveable therewith and (b) a plurality of spaced support elements affixed to the chain and moveable therewith, said support elements being operative to support the hoses during reciprocal movement of the slurry lance.

10. A refractory gunning apparatus for repairing the interior refractory walls of elongated high temperature industrial ovens such as a coke oven, said apparatus being capable of repairing the innermost areas of the refractory walls and including a reciprocal gunning lance, a slurry pipe mounted rotatably internally of the lance and having a nozzle disposed externally of the lance, a pivotal support for the lance, drive means for reciprocating the lance longitudinally relative to the lance support to advance the lance into and retract the lance from an oven and hydraulic control means for positioning the lance and nozzle selectively relative to the interior of the oven, the improvement comprising (a) an elongated gunning lance adapted to be advanced deep into an oven to locate the slurry nozzle substantially beyond the midpoint of the oven, said lance comprising
  (i) a pair of elongated concentric inner and outer lance tubes and
  (ii) a plurality of elongated angularly spaced ribs interposed in liquid tight relationship between the inner and outer lance tubes, said ribs extending continuously substantially the full axial length of the lance,
  (iii) said ribs rigidly securing the inner and outer lance tubes in fixed radially spaced relation to each other,
(b) a plurality of angularly spaced liquid coolant conduits extending substantially the full length of the gunning lance, said lance conduits being spaced radially outward relative to the slurry pipe to provide a protective shield of liquid coolant for the slurry pipe,
(c) each lance conduit being of generally arcuate cross-section and having elongated top, bottom and side walls, each top wall comprising an axially extending segment of the outer lance tube, each bottom wall comprising an axially extending segment of the inner lance tube and each side wall being constituted by one of the fluid tight ribs,
(d) liquid conduit means connected to the lance conduits to provide an internal cooling liquid flow system extending substantially the full length of the lance and
(e) a rotatable articulated support for selectively positioning the lance, said support having an upper end connected pivotally to the lance support,
(f) said articulated support having a bifurcated structure to provide an elongated open space to permit the lance to be positioned selectively intermediate the bifurcated components of said articulated support.

11. The apparatus of claim 10, wherein the lance cooling liquid flow system includes:

(a) a pair of diametrically spaced liquid coolant inlet conduits disposed within the lance,
(b) a pair of diametrically spaced liquid coolant discharge conduits disposed within the lance and
(c) liquid coolant conduit means located internally of the lance at the forward end thereof, proximate the nozzle, to provide communication between the lance inlet conduits and the lance discharge conduits, whereby liquid coolant flows unimpeded from the lance inlet conduits to the lance discharge conduits.

12. The apparatus of claim 11, wherein (a) a plurality of hoses are connected to the gunning lance for delivery of a fluent refractory slurry to the slurry pipe and for delivery and return of liquid coolant and hydraulic fluid to and from the lance and
(b) a plurality of spaced, reciprocally moveable hose support elements are mounted on the gunning lance support to support the plural hoses during reciprocal movement of the gunning lance.

13. The apparatus of claim 11, wherein the elongated gunning lance includes a liquid-cooled gunning lance extension housing a portion of the slurry pipe, said extension including liquid coolant inlet and discharge conduits connected, respectively, to the liquid coolant and discharge conduits of the lance and comprising extensions thereof.

14. The apparatus of claim 13, further including coupling means interposed between the gunning lance and the gunning lance extension, said coupling means including:

(a) angularly spaced liquid coolant conduits connecting the liquid coolant inlet and discharge conduits of the lance with the liquid coolant and discharge conduits of the lance extension and
(b) a centrally located aperture providing clearance for the passage of the slurry pipe from the interior of the lance continuously to and through the interior of the lance extension.

15. A refractory gunning apparatus for repairing the interior refractory walls of elongated high temperature industrial ovens such as a coke oven, said apparatus being capable of repairing the innermost areas of the refractory walls and including a reciprocal gunning lance, a slurry pipe mounted rotatably internally of the lance and having a nozzle disposed externally of the lance, a pivotal support for the lance, drive means for reciprocating the lance longitudinally relative to the lance support to advance the lance into and retract the lance from an oven and hydraulic control means for positioning the lance and nozzle selectively relative to the interior of the oven, the improvement comprising (a) an elongated gunning lance adapted to be advanced deep into an oven to locate the slurry nozzle substantially beyond the midpoint of the oven, said lance comprising
  (i) a pair of elongated concentric inner and outer lance tubes and
  (ii) a plurality of elongated angularly spaced ribs interposed in liquid tight relationship between the inner and outer lance tubes, said ribs extending continuously substantially the full axial length of the lance,
  (iii) said ribs rigidly securing the inner and outer lance tubes in fixed radially spaced relation to each other,
(b) a plurality of angularly spaced liquid coolant conduits disposed in the lance and extending substantially the full length of the slurry pipe, said lance conduits being spaced radially outward relative to the slurry pipe to provide a protective shield of liquid coolant for the slurry pipe,
(c) a plurality of hoses connected to the gunning lance for delivery of a fluent refractory slurry to the slurry pipe and for delivery and return of liquid coolant and hydraulic fluid to and from the lance,
(d) a plurality of spaced, reciprocally moveable hose supports mounted on the gunning lance support to support the plural hoses during reciprocal movement of the gunning lance and
(e) a rotatable articulated support for selectively positioning the lance, said support having an upper end connected pivotally to the lance support,
(f) said articulated support having a bifurcated structure to provide an elongated open space to permit the lance to be positioned selectively intermediate the bifurcated components of said articulated support.

16. A refractory gunning apparatus for repairing the interior refractory walls of elongated high temperature industrial ovens such as a coke oven, said apparatus being capable of repairing the innermost areas of the refractory walls and including a reciprocal gunning lance, cooling liquid conduits disposed internally of the lance, a slurry pipe mounted rotatably internally of the lance and having a nozzle disposed externally of the lance, a pivotal support for the lance, drive means for reciprocating the lance longitudinally relative to the lance support to advance the lance into and retract the lance from an oven and hydraulic control means for positioning the lance and nozzle selectively relative to the interior of the oven, the improvement comprising (a) an elongated gunning lance adapted to be advanced deep into an oven to locate the slurry nozzle substantially beyond the midpoint of the oven, (b) a plurality of hoses connected to the gunning lance for delivery of a fluent refractory slurry to the slurry pipe and for delivery and return of liquid coolant and hydraulic fluid to and from the lance and (c) a plurality of spaced, reciprocally moveable hose supports mounted on the gunning lance support to support the plural hoses during reciprocal movement of the gunning lance.

17. The apparatus of claim 16, further including a rotatable articulated support for selectively positioning the lance, said support having an upper end connected to the lance support and a bifurcated structure to provide an elongated open space to permit the lance support to be positioned selectively intermediate the bifurcated components of said articulated support.

18. The apparatus of claim 16, wherein (a) the drive means for imparting reciprocal movement to the lance comprises (i) an endless reciprocal chain disposed on the gunning lance support and connected to the gunning lance, (ii) a pair of spaced, rotatable wheels about which the chain is entrained and (iii) a reversible hydraulic motor having an output shaft connected to one of the wheels, (b) and the reciprocally moveable hose supports are mounted at spaced intervals on the endless chain.

* * * * *